US009486377B2

(12) United States Patent
Dmello et al.

(10) Patent No.: US 9,486,377 B2
(45) Date of Patent: Nov. 8, 2016

(54) INFANT CARE APPARATUS WITH MULTIPLE USER INTERFACES

(75) Inventors: Melwyn Dominic Dmello, Bangalore (IN); Meenakshisundaram Ramkumar, Bangalore (IN)

(73) Assignee: General Electric Company, Schenectady, NY (US)

( * ) Notice: Subject to any disclaimer, the term of this patent is extended or adjusted under 35 U.S.C. 154(b) by 1842 days.

(21) Appl. No.: 12/628,358

(22) Filed: Dec. 1, 2009

(65) Prior Publication Data

US 2011/0130620 A1 Jun. 2, 2011

(51) Int. Cl.
*A61G 11/00* (2006.01)

(52) U.S. Cl.
CPC ..... *A61G 11/00* (2013.01); *A61G 11/002* (2013.01); *A61G 11/008* (2013.01)

(58) Field of Classification Search
CPC ..... A61G 11/00–11/009
USPC ..... 600/22, 21; 5/607–612, 87.1, 83.1, 5/84.1, 81.1 R, 600, 603; 297/183.1–183.9; 269/95–102; 119/28.5, 722–723, 753
See application file for complete search history.

(56) References Cited

U.S. PATENT DOCUMENTS

| | | | | |
|---|---|---|---|---|
| 5,029,826 | A * | 7/1991 | Schaefer | 5/600 |
| 5,980,449 | A * | 11/1999 | Benson et al. | 600/22 |
| 6,082,693 | A | 7/2000 | Benson et al. | |
| 6,155,970 | A | 12/2000 | Dykes et al. | |
| 6,457,196 | B1 | 10/2002 | Dykes et al. | |
| 6,540,660 | B1 * | 4/2003 | Speraw et al. | 600/22 |
| 6,585,636 | B2 | 7/2003 | Jones et al. | |
| 7,482,558 | B2 * | 1/2009 | Koch | 219/543 |
| 2005/0146187 | A1 * | 7/2005 | Volker et al. | 297/369 |
| 2009/0094745 | A1 * | 4/2009 | Benzo et al. | 5/608 |

* cited by examiner

*Primary Examiner* — Charles A Marmor, II
*Assistant Examiner* — Thaddeus Cox

(57) ABSTRACT

An infant care apparatus with multiple user interfaces is disclosed herewith. The apparatus comprises: a base; a frame member extending upwardly from said base; an infant platform extending outwardly from said frame member positioned above the base and having lateral side walls and a bottom support. The apparatus further comprises a heating arm extending outwardly from said frame member, positioned above the infant platform and at least one drive mechanism connected to the frame member and to the infant platform. The drive mechanism is provided with at least one user interface extending to the lateral side walls of the infant platform for moving the infant platform.

8 Claims, 4 Drawing Sheets

INFANT CARE APPARATUS WITH MULTIPLE USER INTERFACES

FIELD OF THE INVENTION

This invention relates generally to infant care apparatus, and more particularly to, an infant care apparatus with multiple user interfaces for moving infant platform/support.

BACKGROUND OF THE INVENTION

Infant care apparatus such as infant warmers or incubators includes an infant platform, which needs to be moved during a clinical procedure. The infant care apparatus is provided with a drive mechanism to move/tilt the infant platform or the infant bed.

Conventionally a drive control mechanism or a user interface for moving the infant bed is provided at the front side of the infant platform. In a resuscitation situation, the clinician will be standing at the front side of the warmer and therefore, it is difficult for anyone else to access the user interface during resuscitation and move the infant platform appropriately. Further, in an emergency situation, the clinician may be standing near the lateral sides of the warmer. If the user interface is connected at the front side of the warmer it will be difficult for the clinician to access the user interface by himself. Similarly, if the clinician is standing near to the front side of the apparatus, it will be difficult for a caretaker to access and operate the interface, which is located at the front side of the apparatus, without disturbing the clinician or the workflow.

If a clinician is performing a surgical procedure on the NICU, and is standing near to one of the lateral side of the infant, it will be difficult for him to access the user interface connected at the front side or on the other lateral side of the apparatus. Similarly, for a mother who is lying near to the lateral side of the infant care apparatus, it will be difficult to access the interface provided at the front side of the apparatus. Similarly, an infant care giver sitting near to the infant will have problem in accessing the interface, if the interface is provided at the front side of the apparatus.

Thus having one interface or having an interface at the front side of the apparatus for moving the infant platform causes inconvenience to the clinician and the caregiver. Many times if another person needs to access the interface, the workflow or the clinical procedure needs to be interrupted and this will result in wastage of time and affect the efficiency of the process.

Thus there exists a need to provide an improved infant care apparatus with multiple user interfaces for moving the infant platform.

SUMMARY OF THE INVENTION

The above-mentioned shortcomings, disadvantages and problems are addressed herein which will be understood by reading and understanding the following specification.

One embodiment of the present invention provides an infant care apparatus. The apparatus comprises: a base; a frame member extending upwardly from said base; an infant platform extending outwardly from said frame member positioned above the base and having lateral side walls and a bottom support; a heating arm extending outwardly from said frame member, positioned above the infant platform; and at least one drive mechanism connected to the frame member and to the infant platform, the drive mechanism being provided with at least one user interface extending to the lateral side walls of the infant platform for moving the infant platform.

In another embodiment, an infant care apparatus is disclosed. The apparatus comprises: a base; a frame member extending upwardly from said base; an infant platform extending outwardly from said frame member adapted to support an infant, positioned above said base and having lateral side walls and a bottom support; a heating arm extending outwardly from said frame member adapted to warm the infant platform, positioned above said infant platform; and two drive mechanisms extending outwardly from the frame member, each drive mechanism connected in parallel to the bottom support of the infant platform, each drive mechanism being provided with a user interface extending to the lateral side walls of the infant platform for moving the infant platform.

Various other features, objects, and advantages of the invention will be made apparent to those skilled in the art from the accompanying drawings and detailed description thereof.

DETAILED DESCRIPTION OF THE INVENTION

Figure 1:
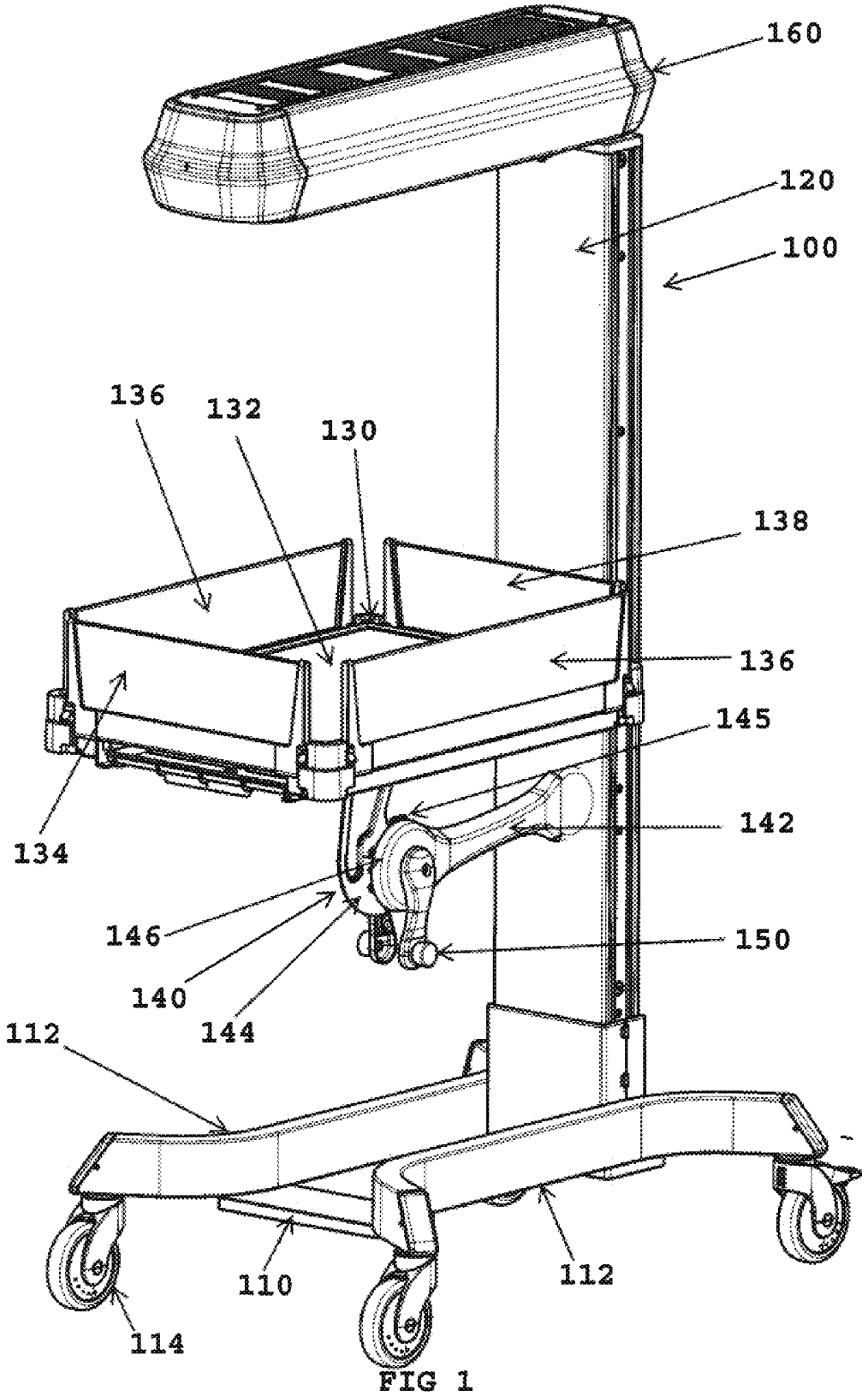
FIG. 1 is a diagrammatic representation of an infant warmer having one drive mechanism and two user interfaces provided on lateral sides of the warmer as described in an embodiment of the invention.

In the following detailed description, reference is made to the accompanying drawings that form a part hereof, and in which is shown by way of illustration specific embodiments that may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken as limiting the scope of the invention. To the extent that the figures illustrate diagrams of the functional blocks of various embodiments, the functional blocks are not necessarily indicative of the division between hardware circuitry. It should be understood that the various embodiments are not limited to the arrangements and instrumentality shown in the drawings.

Embodiments of the present invention assist in moving an infant platform in an infant care apparatus using multiple user interfaces provided on the infant care apparatus. To achieve this, an exemplary embodiment of the present invention provides user interface to control the movement of the infant platform towards the lateral sides of the infant care apparatus.

In an embodiment, an infant warmer having a tiltable infant platform is provided with at least one drive mechanism operable by different user interfaces provided on the lateral sides of the infant warmer.

Even though the infant care apparatus shown in the figures relates to an infant warmer, the application of the invention need not be limited to the warmer. The invention could be applied to any apparatus providing facilities for infant care like incubator or similar other devices, wherein there is a need to tilt or rotate the infant platform. Further the term "lateral sides" refers to the longer sides of the infant care apparatus and these are the sides that are located along the side of the infant when positioned in the warmer 100.

FIG. 1 is a diagrammatic representation of an infant warmer 100 having one drive mechanism and two user interfaces provided on lateral sides of the warmer as described in an embodiment of the invention. The warmer 100 includes a base 110 comprising a pair of lateral base members 112 providing support for a frame member 120. The base members 112 are detachably connected to the frame member 120. Wheels 114 may also be provided for ready movement of the warmer 100. The configuration of the base 110 need not be limited to the example shown in the Figure.

The frame member 120 is a vertical member, extending upwardly from the base 110, providing support to the infant warmer 100. An infant platform 130 is provided to support an infant in the infant warmer 100 and the infant platform 130 is connected to the frame member 120, extending outwardly from the frame member 120. The infant platform 130 may be connected to the frame member 120 through a movable horizontal bar (not shown) extending outwardly from the frame member 120 and supporting the infant platform 130. The infant platform 130 includes a flat, planar bottom surface 132 that actual underlies the infant when positioned with the warmer 100. The infant platform 130 also has a front side wall shown as 134.

Extending upwardly around the periphery of the infant platform 130 are a plurality of lateral side walls 136, normally of a transparent plastic material and which surround the flat planar bottom support 132 to form the infant platform 130 to support the infant in a controlled environment. To access the infant by a caregiver, at least the lateral side walls 136 can be dropped downwardly to open fully for complete access to the infant to carry out procedures on the infant or for introducing and removing the infant from the warmer 100.

As used and shown herein, the term lateral will refer to the sides of the warmer 100 that are the longer dimensioned of the generally rectangular configuration of the infant platform 130 as well as of the warmer 100 and are the sides that are located along the side of the infant when positioned in the warmer 100. The caregiver is normally positioned along the lateral sides of the warmer 100 since that location affords the best access to the full length of an infant positioned within the infant platform. Similarly, if the infant bed is square in shape, the lateral sides could be defined as the sides along the length of a heating arm 160. The heating arm 160 is provided extending outwardly from the frame member 120. The heating arm 160 is preferably placed above the infant platform 130 to provide a controlled heat and air circulation environment for the infant. Similarly, the infant platform 130 could be in oval or circular shape and the lateral sides could be defined along the length of heating arm 160. The heating arm 160 is placed vertically above the infant platform.

Thus, there are a bottom support 132, a front side wall 134, lateral side walls 136 and an end wall 138 to the infant platform 130. A hood (not shown) could be provided covering the upper peripheral edges of the lateral side walls 136 to enclose therein the infant platform 130 that provides a controlled environment where heat and humidity can be controlled to aid in the development and well being of the infant. The hood may be of any conventional design, and can be raised and lowered vertically to partially cover and uncover the infant platform 130.

The infant platform 130 is further connected to the frame member 120 through at least one drive mechanism 140, which is configured to move the infant platform 130. The drive mechanism 140 includes a fixed arm 142 and a movable arm 144. The fixed arm 142 is connected to the frame member 120. The movable arm 144 is connected to the bottom support 132 of the infant platform 130 such that the drive mechanism 140 controls the movement of the infant platform 130. The movable arm 144 of the drive mechanism 140 is connected substantially at the center of the bottom support 132. The movable arm 144 and the fixed arm 142 are connected through a pivotable joint 146. The movable arm 144 moves with reference to the pivot point 146 thereby moving the infant platform 130. In an embodiment, the infant platform 130 may be titled, elevated, lowered and/or rotated using appropriate drive mechanisms 140. The drive mechanism 140 is connected between the base 110 and the bottom support 132, substantially closer to the bottom support 132. The warmer 100 can have one or more drive mechanisms 140 based on the need and application. The drive mechanism 140 further includes a lock mechanism 145 configured to lock the infant platform 130 at the moved location or at the new position. Examples of the drive mechanism include rotating gear mechanism, gas spring mechanism, switch mechanism and lead-screw mechanism, but need not be limited to these. The drive mechanism 140 is operated manually through a user interface 150.

At least one user interface 150 is provided on the drive mechanism 140 extending outwardly towards the lateral side walls 136 of the infant platform 130 to control the movement of the infant platform 130. The user interface 150 is connected to the drive mechanism 140, substantially near to the pivot joint 146. Examples of the user interface 150 include a touch panel, lever, rotary knob or similar mechanisms. Based on the mode of operation, the user interface 150 may be connected at the appropriate location on the warmer 100. However, by operating the user interface 150, a user should be able to control the movement of the infant platform 130 through the drive mechanism 140. The caretaker or the clinician could access the user interface 150 from the lateral sides of the warmer 100 and by operating the user interface 150, the drive mechanism 140 moves the infant platform 130.

A control module (not shown) is conveniently positioned on the frame member 120 and may include displays of various monitored parameters as well as include the various controls for operation of the functions of the warmer 100.

Optionally, between the base 110 and the infant platform 130 appropriate storage arrangements (not shown) may be provided to store various things associated with the infant care.

Figure 2:
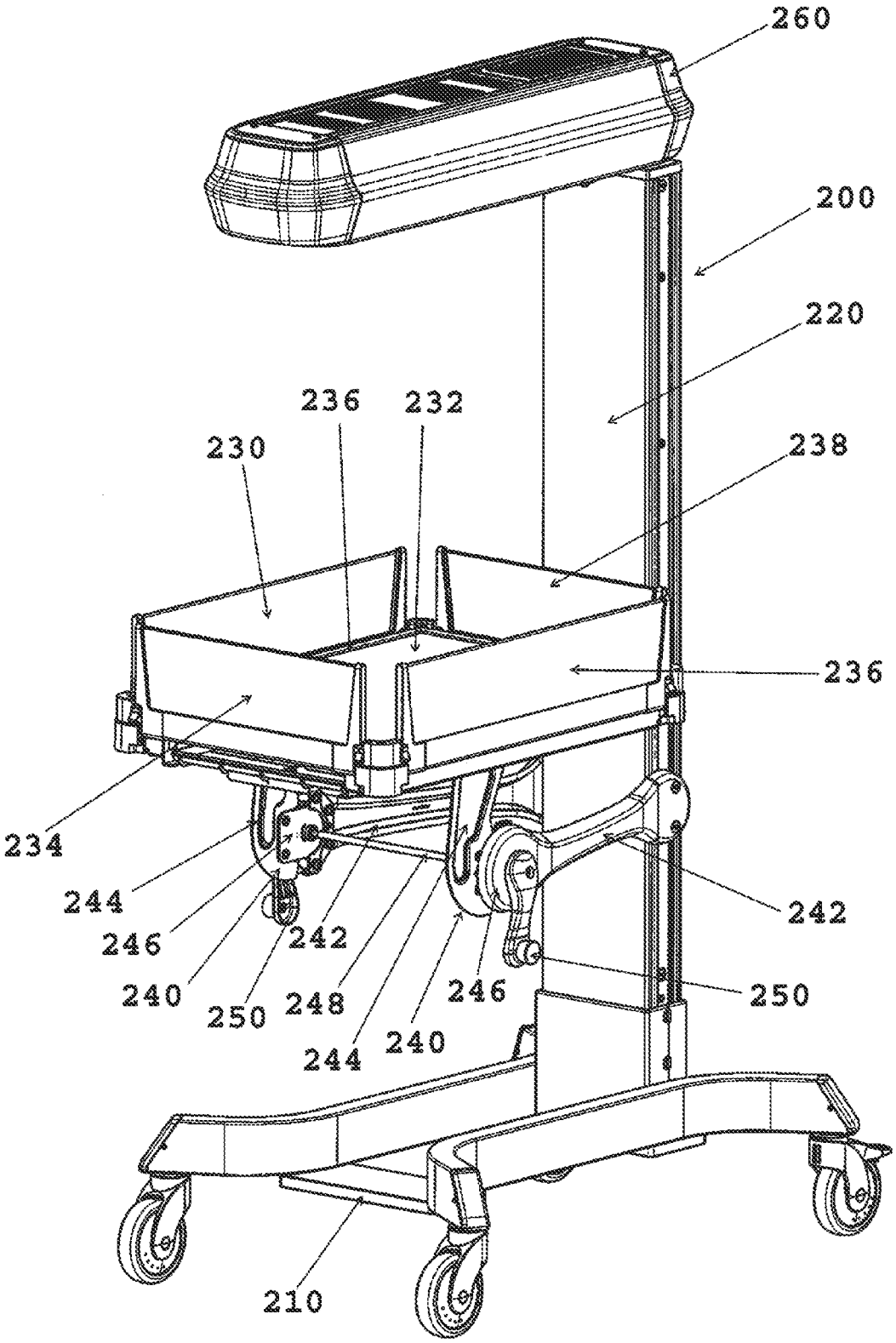
FIG. 2 is a diagrammatic representation of an infant warmer having two drive mechanism and two user interfaces provided on lateral sides of the warmer as described in an embodiment of the invention.

FIG. 2 is a diagrammatic representation of an infant warmer having two drive mechanisms and two user interfaces provided on lateral sides of the warmer as described in an embodiment of the invention. The warmer 200 includes a base 210, a frame member 220, an infant platform 230, and a heating arm 260. The infant platform 230 includes a bottom support 232, a front side wall 234, lateral side walls 236 and an end wall 238 to the infant platform 230. The heating arm 260 is located extending outwardly from said frame member 220 adapted to warm the infant platform 230, positioned above said infant platform 230. The structure, design and connection of these components are similar to the ones explained with reference to FIG. 1.

The warmer 200 further comprises two drive mechanisms 240 connected to the base support of the infant platform. The constructional and positional aspects of the drive mechanism remain the same as that described with reference to FIG. 1. The drive mechanisms 240 extending outwardly from the frame member 220 are configured to support the infant platform 230. Each drive mechanism 240 has a fixed arm 242 connected to the frame member 220 and a movable arm 244 connected to the bottom support 232. Each fixed arm 242 and movable arm 244 are connected through a pivot joint 246. The movable arm 244 moves with reference to the pivot joint 246, thereby moving the infant platform. Each drive mechanism 240 is provided with a user interface 250 to operate the drive mechanism 240. To synchronize the operation of the two drive mechanisms 240 a connecting rod 248 is provided connecting the two drive mechanisms 240. The infant platform 230 can be moved by operating either of drive mechanisms 240 using the corresponding user interfaces 250. This facilitates moving the infant platform from one of the lateral sides of the infant warmer 200.

In an embodiment, the user interface 250 is a lever mechanism connected to both the driving mechanisms 240. In an embodiment, the user interface is a lever connected to the drive mechanism 240. By rotating the lever on either side, the movable arms 244 of each driving mechanism 240 pivots with reference to the corresponding pivot joint 246 and thereby tilting the infant platform 230. The lever on rotating actuates the drive mechanism 240 and also provides much needed leverage to operate the mechanism. The drive mechanism 240 is located centrally below the infant platform 230 so that force required to tilt the infant platform 230 to any of the lateral sides of the warmer 200.

Figure 3B:
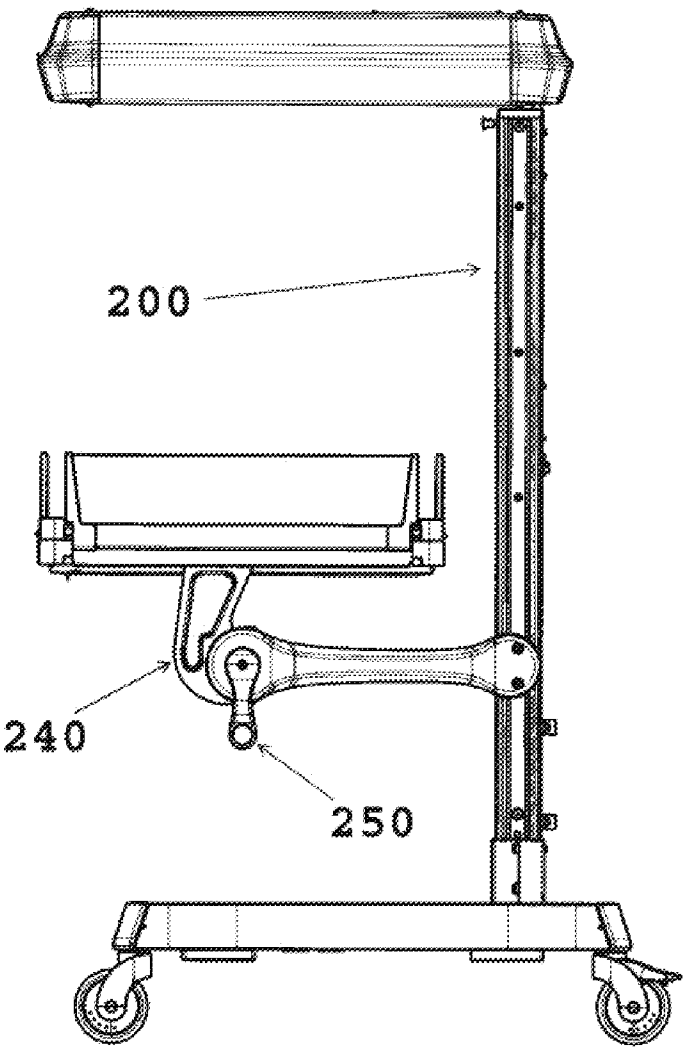
FIGS. 3A and 3B are the front and side views of the infant warmer shown in FIG. 2.
Figure 3A:
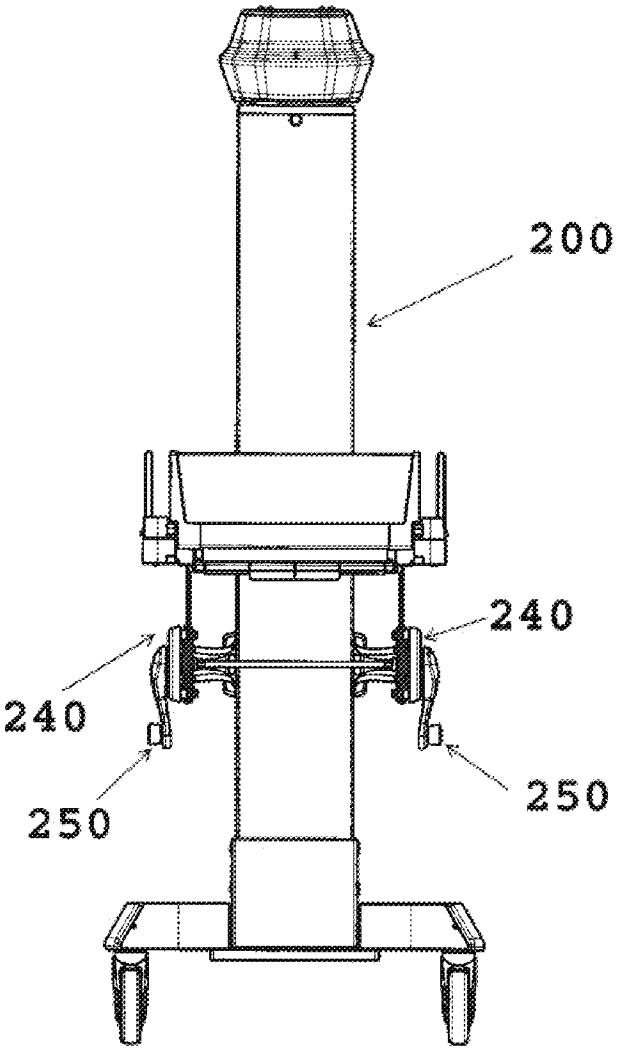

FIGS. 3A and 3B are the front and side views of the warmer shown in FIG. 2. FIG. 3 A shows the front view of the infant warmer 200. The warmer 200 is shown with two drive mechanisms 240, each driving mechanism 240 having a user interface 250. FIG. 3B shows the side view of the infant warmer 200. The side view shows one drive mechanism 240 on the lateral side of the infant warmer and the drive mechanism is provided with a user interface 250.

Figure 4:
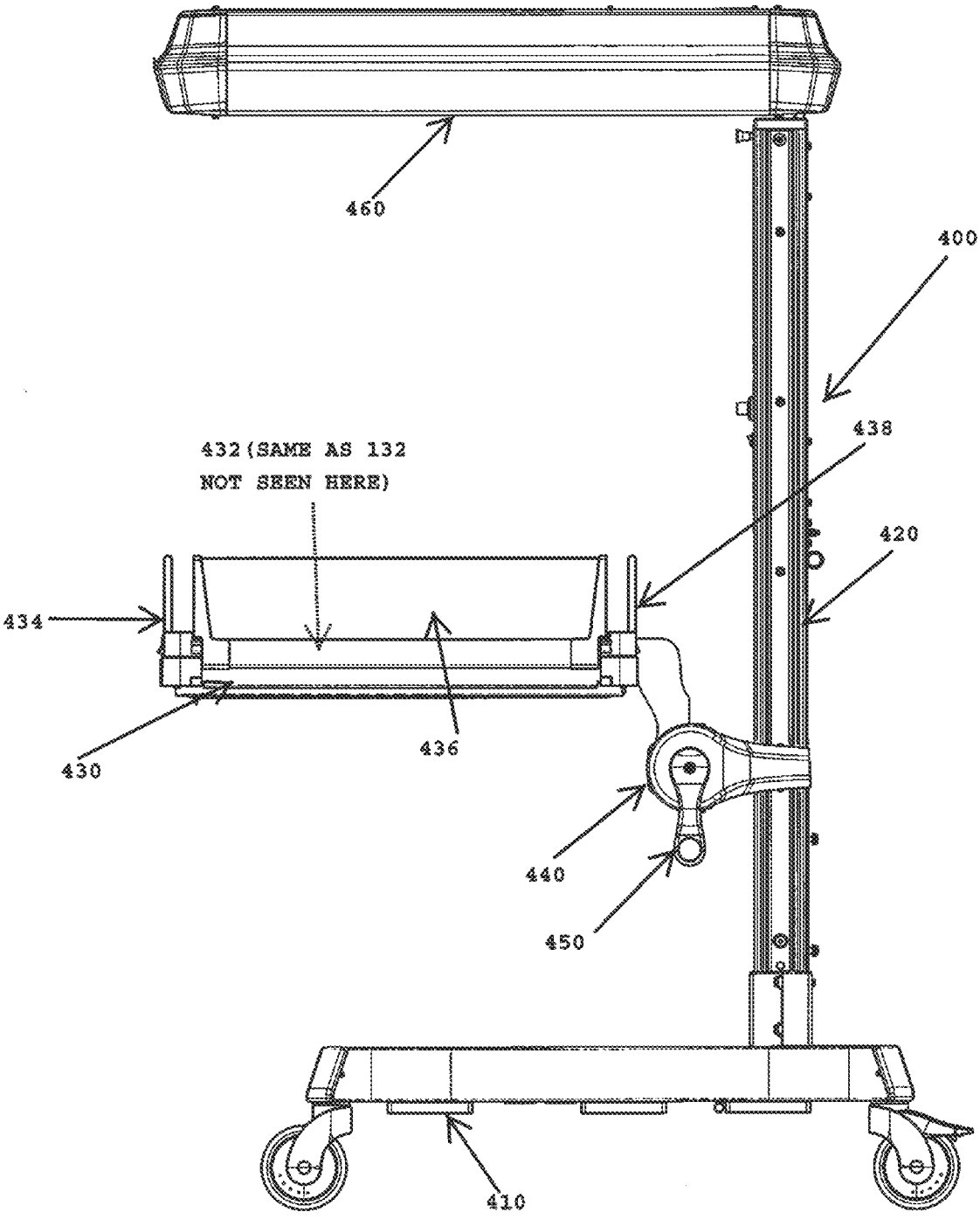
FIG. 4 is a diagrammatic representation of an infant warmer as described in another embodiment of the invention.

FIG. 4 is a side view of an infant warmer as described in another embodiment of the invention. The warmer 400 includes a base 410, a frame member 420, an infant platform 430, and a heating arm 460. The infant platform 430 includes a bottom support 432, a front side wall 434, lateral side walls 436 and an end wall 438 to the infant platform 430. The heating arm 460 is located extending outwardly from said frame member 420 adapted to warm the infant platform 430, positioned above said infant platform 430. The structure, design and connection of these components are similar to the ones explained with reference to FIG. 1.

The warmer 400 further comprises one or more drive mechanisms 440 connected to the end wall 438 of the infant platform. The constructional and positional aspects of the drive mechanism 440 remain the same as that described with reference to FIG. 1. Each drive mechanism 440 could be provided with two user interfaces 450. Each user interface 450 extends laterally along the side walls 436 of the infant platform 430. By operating the user interface 450, the infant platform could be tilted or rotated.

Since the user interface are located on either side of the infant platform, the clinician can work continuously on the infant from one of the lateral sides, whereas a second clinician can operate the user interface from the other lateral side with out interrupting the work flow.

The advantages of the invention include allowing a user to perform procedures on the infant without having to move from his/her position, simplifying the workflow. This helps in reducing the stress on patient/caregiver. The design is simple and compact for easy assembly and better reliability and serviceability. The sleek design allows more space for utility below the bed and ergonomic design of the drive mechanism allows easy and uninterrupted operation of mechanism.

As used herein, an element or step recited in the singular and proceeded with the word "a" or "an" should be understood as not excluding plural elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Exemplary embodiments are described above in detail. The assemblies and methods are not limited to the specific embodiments described herein, but rather, components of each assembly and/or method may be utilized independently and separately from other components described herein. Further the steps involved in the workflow need not follow the sequence in which there are illustrated in figures and all the steps in the work flow need not be performed necessarily to complete the method.

While the invention has been described with reference to preferred embodiments, those skilled in the art will appreciate that certain substitutions, alterations and omissions may be made to the embodiments without departing from the spirit of the invention. Accordingly, the foregoing description is meant to be exemplary only, and should not limit the scope of the invention as set forth in the following claims.

We claim:

1. An infant care apparatus comprising:

a base;

a frame member extending upwardly from said base;

an infant platform extending outwardly from said frame member adapted to support an infant, positioned above said base and having lateral side walls and a bottom support;

a heating arm extending outwardly from said frame member adapted to warm the infant platform, positioned above said infant platform; and two drive mechanisms extending outwardly from the frame member, each drive mechanism connected in parallel to the bottom support of the infant platform, each drive mechanism being provided with a user interface extending to one of the lateral side walls of the infant platform for moving the infant platform.

2. The apparatus as claimed in claim 1, wherein each drive mechanism is located between the infant platform and the base, each drive mechanism being substantially closer to the infant platform.

3. The apparatus as claimed in claim 2, wherein each drive mechanism has a movable arm and a fixed arm both connected pivotably through a pivotable joint, each fixed arm being connected to the frame member and each movable arm to the infant platform.

4. The apparatus as claimed in claim 3, wherein a connecting rod is provided connecting the two drive mechanisms to synchronize the operation of the drive mechanisms, the connecting rod being connected at the pivotable joints.

5. The apparatus as claimed in claim 1, wherein both drive mechanisms are operated by one of the user interfaces.

6. The apparatus as claimed in claim 5, wherein each user interface is a lever mechanism, the infant platform being tilted by rotating either lever mechanism.

7. The apparatus as claimed in claim 3, wherein each drive mechanism includes a lock mechanism to retain a moved position of the infant platform.

8. An infant care apparatus comprising:

a base;

a frame member extending upwardly from said base;

an infant platform extending outwardly from said frame member positioned above the base and having a front side wall, lateral side walls, an end wall and a bottom support;

a heating arm extending outwardly from said frame member, positioned above the infant platform; and at least one drive mechanism connected to the frame member and to the end wall of the infant platform, the drive mechanism being provided with at least one user interface extending to the lateral side walls of the infant platform for moving the infant platform.

* * * * *